US006581304B2

(12) United States Patent
Mitchell

(10) Patent No.: US 6,581,304 B2
(45) **Date of Patent: *Jun. 24, 2003**

(54) SAFETY SHOE

(75) Inventor: David Mitchell, Clarksville, TN (US)

(73) Assignee: Georgia Boot LLC, Franklin, TN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 72 days.

(21) Appl. No.: 09/474,179

(22) Filed: Dec. 29, 1999

(65) Prior Publication Data

US 2001/0007179 A1 Jul. 12, 2001

(51) Int. Cl.[7] ..... A43C 13/14
(52) U.S. Cl. ..... 36/77 R; 36/96; 36/103
(58) Field of Search ..... 36/77 R, 96, 103, 36/107, 108, 76 R, 72 R, 73

(56) References Cited

U.S. PATENT DOCUMENTS

| | | | | | |
|---|---|---|---|---|---|
| 2,795,868 | A | * | 6/1957 | Schultz | 36/77 R |
| 3,034,235 | A | | 5/1962 | Hunting et al. | 36/77 |
| 3,986,279 | A | | 10/1976 | Gagnon | 36/46 |
| 4,257,177 | A | * | 3/1981 | Unstead | 36/77 R |
| 4,575,953 | A | * | 3/1986 | Hetzel | 36/77 R |
| 5,007,184 | A | | 4/1991 | Lee | 36/77 |
| 5,111,597 | A | * | 5/1992 | Hansen et al. | 36/77 R |
| 5,893,186 | A | * | 4/1999 | Issler et al. | 12/146 C |
| 5,974,697 | A | | 11/1999 | Tseng | 36/77 |

FOREIGN PATENT DOCUMENTS

| | | |
|---|---|---|
| CA | 2060467 | 8/1993 |

* cited by examiner

*Primary Examiner*—Mickey Yu
*Assistant Examiner*—Troy Arnold
(74) *Attorney, Agent, or Firm*—Milton Wolson

(57) ABSTRACT

A safety shoe includes an upper, a steel toe, an outsole and a partial insole tuck for preventing rearward movement of the steel toe.

11 Claims, 2 Drawing Sheets

SAFETY SHOE

FIELD OF THE INVENTION

This invention relates broadly to the field of safety shoes and more particularly to safety shoes having a steel toe box for protecting the wearer's toes.

STATE OF THE ART

Safety shoes having a steel toe box for protecting the wearer's toes are well known. At times however, when the front of such a safety shoe is impacted with considerable force, the steel toe box may move rearwardly onto the wearer's toes. To prevent that occurrence, safety shoes have included, for example, an insole of rigid material which resists rearward movement of the steel toe box upon impact. An insole of this type is disclosed in Canadian Patent Application No. 2,060,467 titled "Inner Sole Structure for Safety Shoes." However, because such insoles extend the entire length of the shoe they tend to lessen the overall flexibility of the shoe and weight of the shoe. U.S. Pat. No. 3,034,235 titled "Protective Toe Structure for Shoes" is also concerned with a safety shoe having a steel toe. In this patent, a generally U-shaped supporting member is located beneath the steel toe for distributing the load from the steel toe over a sufficiently large area. The patent recites that the U-shaped supporting member is located considerably ahead of the point of primary flexure of the sole. The U-shaped supporting member does not, however, prevent rearward movement of the steel toe box onto the wearer's toes, if the front of the shoe is impacted by a considerable force.

SUMMARY OF THE INVENTION

It is an object o t e present invention to provide a safety shoe having a protective toe and a partial insole tuck for preventing rearward movement of the protective toe onto the wearer's toes.

It is another object of the invention to provide a partial insole tuck for preventing rearward movement of a protective toe onto the wearer's foot which does not lessen the flexibility of the shoe.

It is a still further object of the invention to provide a partial insole tuck for preventing rearward movement of a protective toe onto the wearer's foot which is of lightweight and simple construction.

Additional objects and advantages of the invention will become apparent to those skilled in the art upon reference to the detailed description taken in conjunction with the provided figures.

DETAILED DESCRIPTION OF THE PREFERRED EMBODIMENT

Figure 1:
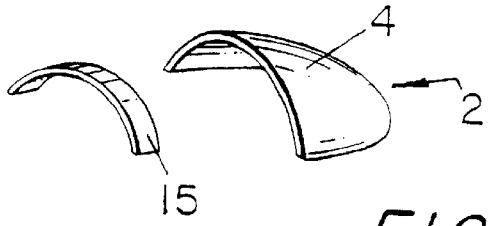
FIG. 1 is a perspective view of the steel toe and flexible strip utilized in the present invention.
Figure 2:
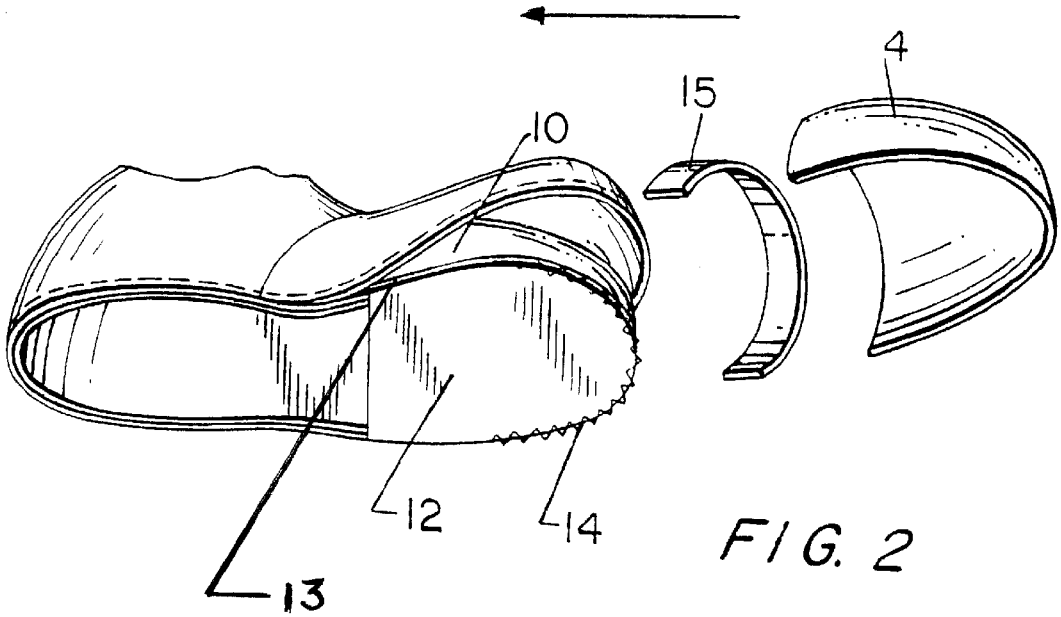
FIG. 2 is an exploded perspective view showing the safety shoe of the present invention as it is being assembled.
Figure 3:
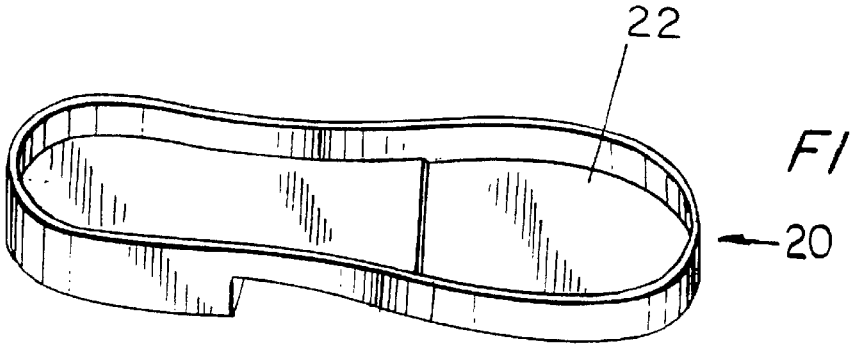
FIG. 3 is a perspective view of the outer sole of the present invention.

Turning to FIG. 1 there is shown a conventional dome-shaped protective toe 2 having a sheath portion 4 at its upper end. The protective toe 2 may be formed of steel, metal, metal alloy, semi-rigid plastic or other suitable material.

Figure 4:
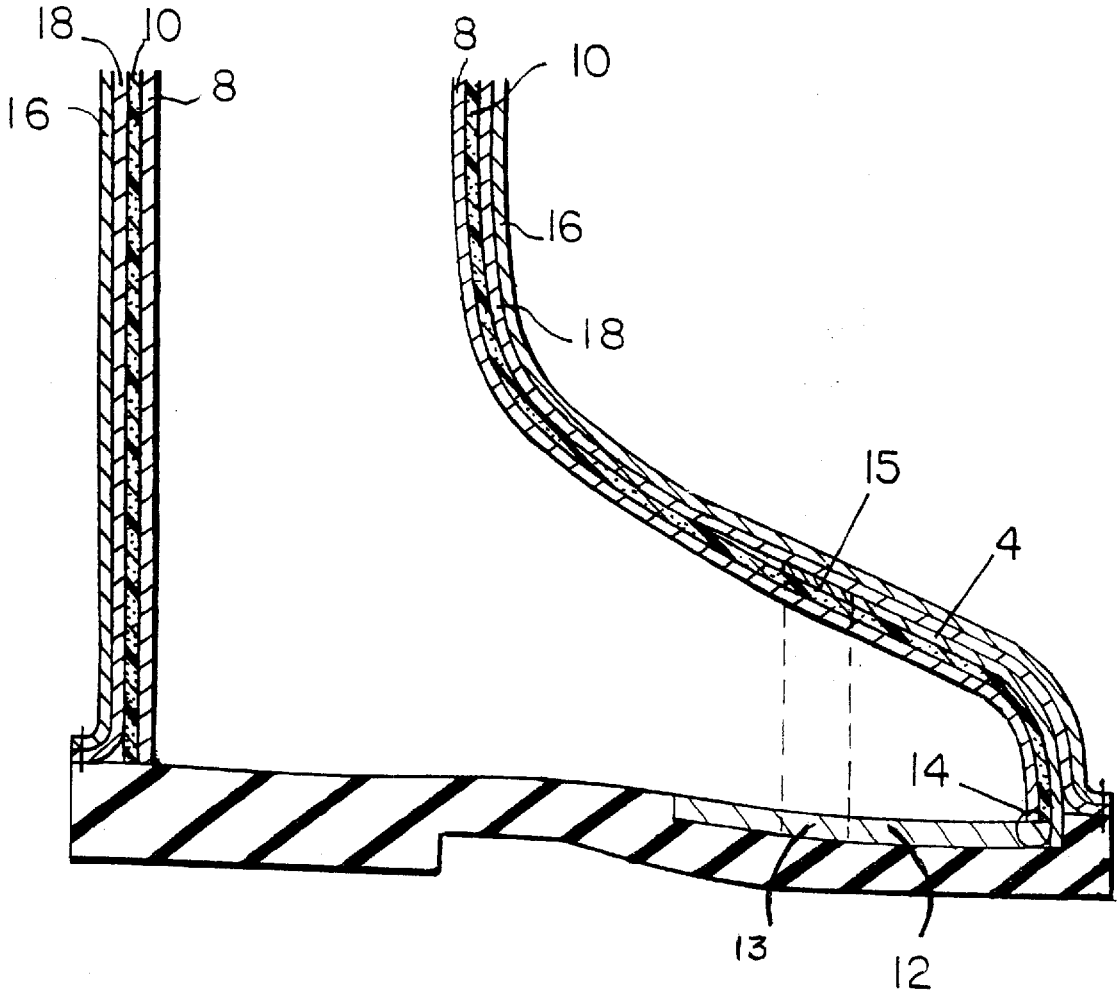
FIG. 4 is a lengthwise sectional view of the safety shoe shown in FIG. 2 and FIG. 3 after assembly.

To produce the safety shoe of the present invention a lining 8, which may be nylon or other suitable material, see FIG. 4, is placed on a last in known fashion. A foam open cell layer 10, formed of polyurethane, latex, polyvinyl chloride or other suitable material is then flow bonded to lining 8. Foam open cell layer 10 provides comfort and a soft feel to the wearer and also provides a surface area upon which the steel toe 2 may be readily cemented. Next, a substantially flat partial insole tuck 12 having an edge surface 13 is secured to the lining 8 and foam open cell layer 10 by, for example, strobel stitching 14. The partial insole tuck 12 extends rearwardly to a position less than the entire length of the shoe interior and therefore does not lessen the overall flexibility of the shoe, nor does it contribute as much weight to the shoe as would an insole extending the entire length of the shoe. Partial insole tuck 12 may be formed of fiberboard, as well as other suitable materials. After partial insole tuck 12 is attached to lining 8 and foam open cell layer 14, steel toe 2 is moved (in the direction of the arrow) over foam open cell layer 10, and cemented thereto. The shape of the steel toe 2 is the same as the shape of the front of partial insole tuck 12 so that partial insole tuck 12 fits snugly within steel toe 2. A flexible strip 15, see FIG. 1, formed of plastic, rubber, felt or other material may be added behind the rear of the steel toe and secured to the open cell layer 14 for the purpose of providing a smooth surface behind steel toe 2.

As seen in FIG. 4, an upper 16, which may be formed of leather or other suitable material, may have a non-woven backing 18 of nylon, cotton or other suitable material secured to the inside. After protective toe 2 and foam open cell layer 10 are cemented together, the toe area of leather upper 16, containing non-woven backing 18 thereunder, is placed over protective toe 2 and non-woven backing 18 is secured to protective toe 2 by cement, or by other suitable means. Non-woven backing 18 adds firmness to the shoe and bridges the space between the leather upper 16 and protective toe 2.

Outsole 20 which may be formed of polyurethane, molded thermoplastic urethane or other suitable material includes a depression 22 in the same shape as partial insole tuck 12. The outsole 20 is secured to the leather upper 16 by a handsewn corner stitch, or by other suitable means, in such a manner that partial insole tuck 12 is seated in depression 22 of outsole.

It will thus be seen that partial tuck 12 prevents rearward movement of the steel toe onto the wearer's toes if the front of the shoe is impacted by a force of unanticipated magnitude. This is achieved in a simple manner, without lessening the flexibility of the shoe, and without increasing the weight of the shoe to the same extent as would an insole that extends the entire length of the shoe interior. While a particular embodiment of the invention has been described, it is not intended that the invention be limited thereto, as it is intended that the invention be as broad in scope as the art will allow and that the specification be read likewise.

I claim:

1. An improved safety shoe having an upper, a protective toe, and an outsole comprising a substantially flat partial insole tuck having an edge surface located within the protective toe, wherein said partial insole tuck prevents rearward movement of the protective toe and wherein the length of said partial insole tuck is less than the length of the shoe interior.

2. An improved safety shoe according to claim 1 and wherein said partial insole tuck is formed of flexible material.

3. An improved safety shoe according to claim 1 and wherein said protective toe is formed of steel.

4. An improved safety shoe according to claim 2 having a layer beneath said upper and wherein said partial insole tuck is attached to said layer.

5. An improved safety shoe according to claim 4 wherein said partial insole tuck is attached to said layer by strobel stitching.

6. An improved safety shoe according to claim 1 and wherein said outsole has a depression therein which is the same shape as the partial insole tuck, and wherein the partial insole tuck is seated in the outsole depression.

7. An improved safety shoe according to claim 1 and further comprising an out sole connected to the upper by corner stitching.

8. An improved safety shoe according to claim 1 wherein said upper is formed of leather.

9. An improved safety shoe according to claim 2 wherein said outsole is formed of polyurethane.

10. An improved safety shoe according to claim 2 wherein said outsole is formed of thermoplastic urethane.

11. An improved safety shoe according to claim 2 wherein the partial insole tuck is formed of fiberboard.

* * * * *